US005346667A

United States Patent [19]

Kamitsuma et al.

[11] Patent Number: 5,346,667

[45] Date of Patent: Sep. 13, 1994

[54] METHOD OF MANUFACTURING SINTERED ALUMINUM ALLOY PARTS

[75] Inventors: Yasuo Kamitsuma, Mito; Yusaku Nakagawa, Hitachi; Yoshihiro Kobayashi, Hitachi; Shoichi Nakashima, Hitachi; Tadashi Iizuka, Ashikaga; Keiichi Nakamura, Tokyo; Hideo Shikata, Matsudo, all of Japan

[73] Assignees: Hitachi, Ltd., Tokyo; Hitachi Powdered Metals Co., Ltd., Matsudo, both of Japan

[21] Appl. No.: 953,018

[22] Filed: Sep. 29, 1992

[30] Foreign Application Priority Data

Oct. 1, 1991 [JP] Japan ..... 3-252676

[51] Int. Cl.[5] ..... B22F 9/00

[52] U.S. Cl. ..... 419/52; 419/29

[58] Field of Search ..... 419/29, 52

[56] References Cited

U.S. PATENT DOCUMENTS

| | | | |
|---|---|---|---|
| 4,432,296 | 3/1969 | McKinnon et al. | 75/214 |
| 4,435,213 | 3/1984 | Hildeman et al. | 75/249 |
| 4,702,885 | 10/1987 | Odani et al. | 419/23 |
| 4,853,179 | 8/1989 | Shiina | 419/28 |
| 4,929,415 | 5/1990 | Okazaki | 419/52 |
| 4,933,140 | 6/1990 | Oslin | 419/23 |

FOREIGN PATENT DOCUMENTS

| | | |
|---|---|---|
| 0112787 | 7/1984 | European Pat. Off. . |
| 0147769 | 7/1985 | European Pat. Off. . |
| 0254698 | 1/1988 | European Pat. Off. . |
| 0265307 | 4/1988 | European Pat. Off. . |

*Primary Examiner*—Peter A. Nelson

*Attorney, Agent, or Firm*—Antonelli, Terry, Stout & Kraus

[57] ABSTRACT

A method of manufacturing sintered Al-Si series alloy parts having complex configurations such as scroll shaped parts wherein Al-Si series alloy powder solidified via rapid cooling prepared by adding effective components such as Si, Cu, Mg, Fe, Mn, Zr and Ce to Al is compression molded, the molded body is sintered by heating via an electrical current conduction in a form of a plasma discharge and then the sintered body is worked by pressing, thereby the parts having complex configurations of light weight, high mechanical strength and toughness is manufactured with a simple installation and reduced processing manhours, and with a high efficiency and at a low cost.

9 Claims, 5 Drawing Sheets

METHOD OF MANUFACTURING SINTERED ALUMINUM ALLOY PARTS

BACKGROUND OF THE INVENTION

1. Field of the Invention

The present invention relates to a method of manufacturing sintered aluminum alloy parts using Al-Si series alloy powder as a raw material and, in particular, relates to a method of manufacturing sintered aluminum alloy parts incorporating an improved sintering method.

2. Description of Related Art

As examples of ferrous series metal materials such as cast iron and sintered iron were known as the material such as for scroll shaped revolving and stationary parts in a scroll type compressor. Further, as examples of non-ferrous series metal materials aluminum alloy (for example Al-Si alloy) as a light weight material was used and casting and die-casting methods were known therefor. Still further JP-A-62-96603 (1987) discloses a method of manufacturing sintered Al alloy parts.

JP-A-64-56806 (1989) discloses a manufacturing of scroll shaped parts wherein an Al alloy powder solidified via rapid cooling which is obtained by a gas atomizing method after melting an Al alloy is used, and after compression molding, in other words compacting, the Al alloy powder, the scroll shaped parts are manufactured via a hot extrusion, a hot forging after a hot extrusion or a hot forging. The Al-Si powder wherein Si is added to Al shows an advantage of reducing the thermal expansion coefficient of the product, however during the heating process at a high temperature the Al-Si powder is vigorously oxidized which extremely deteriorates the workability of the product so that such oxidation has to be prevented.

As explained above, when parts having a complex shape such as the scroll shaped parts were manufactured such as by processings of the hot forging and the extrusion after compression molding the alloy powder obtained by adding an effective element such as Si to the powder solidified via rapid cooling of the Al alloy according to the conventional method, the working of the product was rendered difficult because of the embrittlement thereof due to the oxidation at a high temperature, therefore a long manufacturing time was required therefor, further there were problems with regard to the mechanical strength and toughness of the product, still further there was a drawback that the product thus manufactured raised the production cost.

SUMMARY OF THE INVENTION

An object of the present invention is to provide a method of manufacturing sintered Al alloy parts of a light weight, an excellent mechanical strength and toughness having a complex shape wherein a high Si-Al alloy powder is used and a manufacturing process which produces a high density Al alloy sintered body is introduced.

The method of manufacturing sintered aluminum alloy parts according to the present invention for solving the above problems comprises the steps of compression molding an Al alloy powder solidified via rapid cooling obtained by adding Si powder of 1~45 wt %, powder of an element in III a group of 0.1~20 wt % and powder of at least one element in IV a group and/or V a group of 0.01~5 wt % to Al powder, and thereafter sintering the same by heating via an electric current conduction in a form of a plasma discharge while applying a pressure thereto.

It is, for example, necessary to reduce the clearance between the scroll shaped revolving and stationary parts for enhancing the performance of a scroll type compressor. For this purpose, the sintered Al alloy has to have a small thermal expansion coefficient comparable to that of a cast iron which has been used long, and the thermal deformation thereof also has to be limited as small as possible. When a reduction of thermal expansion coefficient of the product is only required, it will be enough to add, for example Si of 1~45 wt % to Al powder, however in order to provide a hot workability, an age hardening property, a high mechanical strength and toughness at a high temperature it is necessary to add optimum amounts of effective components such as Cu, Mn, Zn, Fe, Co and W.

Namely, in the present invention, when the amount of Si is less than 1 wt % a sufficient mechanical strength and wear and abrasion resistance of the resultant product can not be obtained, on the other hand, when the amount of Si exceeds 45 wt % the ductility thereof reduces such that the amount of Si is determined between 1~45 wt % (preferably 12.2~25 wt %). In order to increase mechanical strength of the resultant product it is preferable to further incorporate Cu of 1~5 wt %, Fe of 0.1~1.0 wt %, Mn of 0.1~2 wt %, Mg of 0.1~1 wt %, Zr of 0.5~5 wt % and Ce of 0.5~5 wt %.

Further, it was found out that a reduction of mechanical strength after sintering Al alloy powder is caused by weaking of the coupling force between particles because of remaining oxidized films on the surfaces of the powder particles. Accordingly, in order to increase the coupling force between particles it was found out that an addition of an element in III a group, in particular Ce in rare earth elements and at least one element in IV a and V a groups, in particular Zr which serve as a deoxidizing component for the alloy powder was effective, therefore these components of a proper amount are added.

After compression molding the Al alloy powder, the molded body is pressed by a low pressure and an electric current is conducted therethrough to cause a plasma discharge between the pressed powder particles so as to remove the oxidized films. In this instance, the most optimum plasma discharge is generated at a plasma voltage of 2~10V and a plasma current of 1000~6500A, and the applied pressure upon the molded body is adjusted while causing discharge of the adsorbed gas on the particle surfaces. The plasma discharge of the present invention is carried out in the atmosphere.

After completing the gas discharge, the molded body is further pressed to produce a sintered body in which the particles are firmly coupled. In order to obtain a sintered body having a high density, the pressure applied to the molded body and the total sintering time are respectively selected in the ranges of 50~300 $Kgf/cm^2$ and of 5~20 minutes.

The sintered alloy product manufactured according to the present invention has a high density as well as an excellent mechanical strength and toughness and the manufacturing method is suitable for manufacturing parts of light weight and small size and of a complex configuration such as a scroll shaped parts for a scroll type compressor.

DESCRIPTION OF THE EMBODIMENTS

Hereinbelow, embodiments according to the present invention and the experimental results thereof are explained with reference to FIG. 1~FIG. 7.

Figure 1:
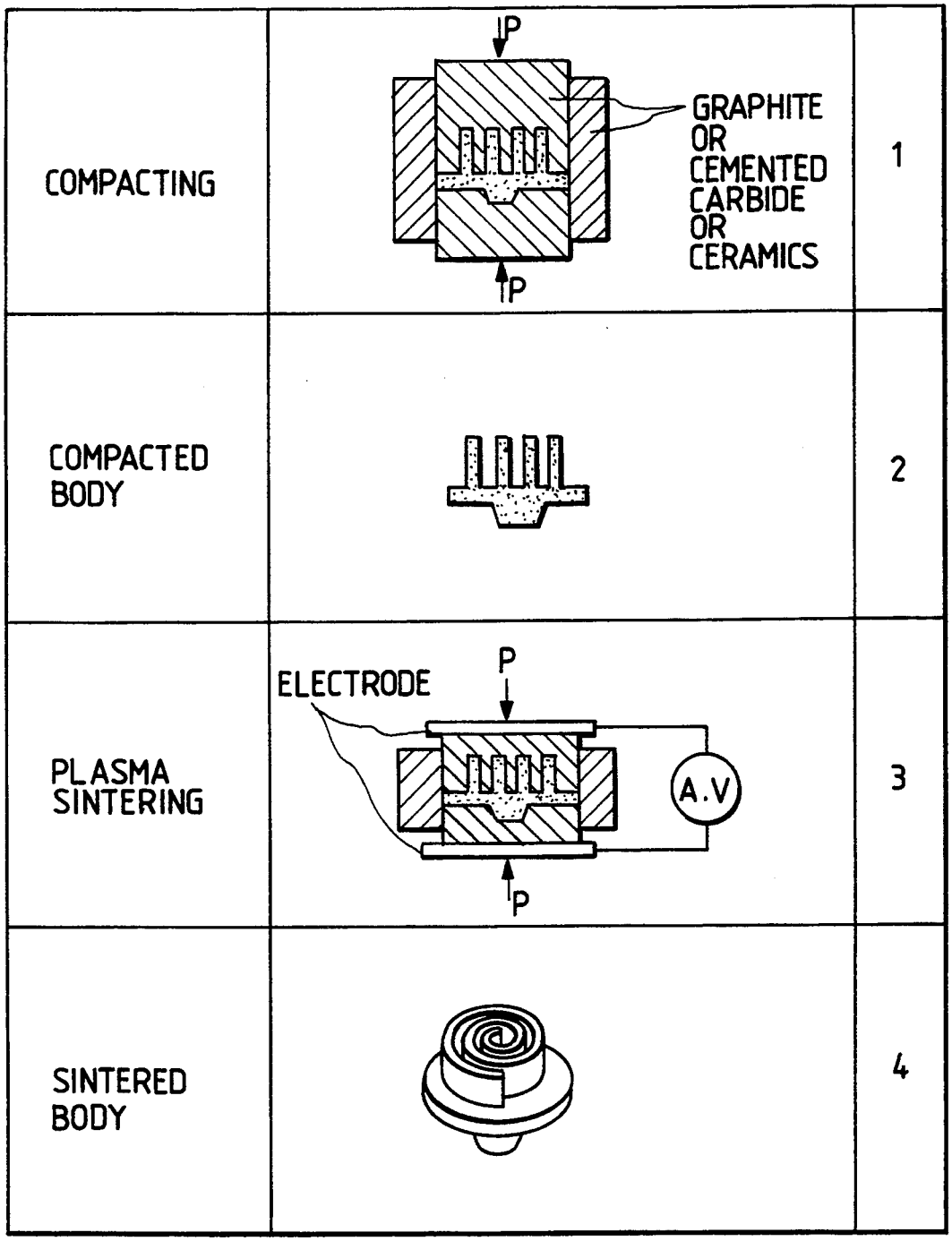
FIG. 1 is a schematic diagram of manufacturing processes of a scroll shaped part of one embodiment according to the present invention.

FIG. 1 is a schematic diagram for explaining the manufacturing processes of a scroll shaped part of one embodiment according to the present invention.

In FIG. 1, 1 is a compacting process, 2 is a compacted body, 3 is a plasma sintering process and 4 is a sintered body.

An Al alloy powder having a composition of Si of 25 wt %, Cu of 3.5 wt %, Mg of 0.5 wt %, Fe of 0.5 wt %, Mn of 0.5 wt %, Zr of 1.0 wt %, Ce of 2.0 wt % and Al of remaining wt % was used, the Al alloy powder was melted and thereafter air-atomized wherein the diameter of the particles was controlled to be less than 500 μm.

At first, in the compacting process, the Al alloy powder was compacted by making use of a graphite die to produce the compacted body 2, and the compacted body 2 was inserted into a graphite die having the same configuration as the scroll shaped part and pressed up to an applied pressure of 200 Kgf/cm$^2$ while causing a plasma discharge therein at plasma current of 5000A and plasma voltage of 5V to obtain the sintered body 4. Wherein the resultant sintered body was 85Φmm×40t mm in a scroll shape.

Figure 2:
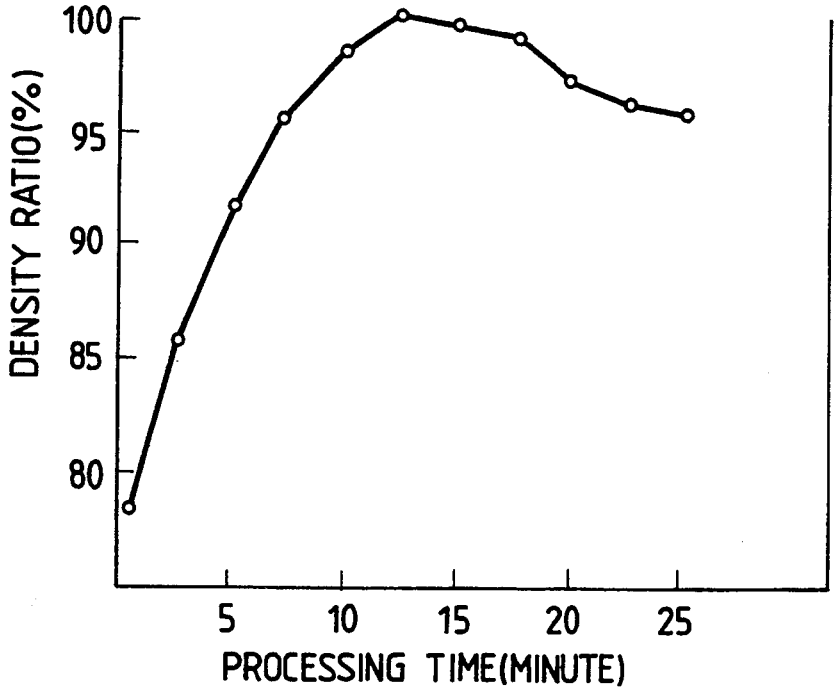
FIG. 2 is a diagram showing a relationship between plasma sinter processing time and the density ratio of the above embodiment.

FIG. 2 is a diagram showing a relationship between plasma sinter processing time and the density ratio of the resultant body in the above process. It will be seen from the diagram that the optimum holding time is 12 minutes and when the holding time is more than 5 minutes a density ratio of 90% is obtained.

Figure 3:
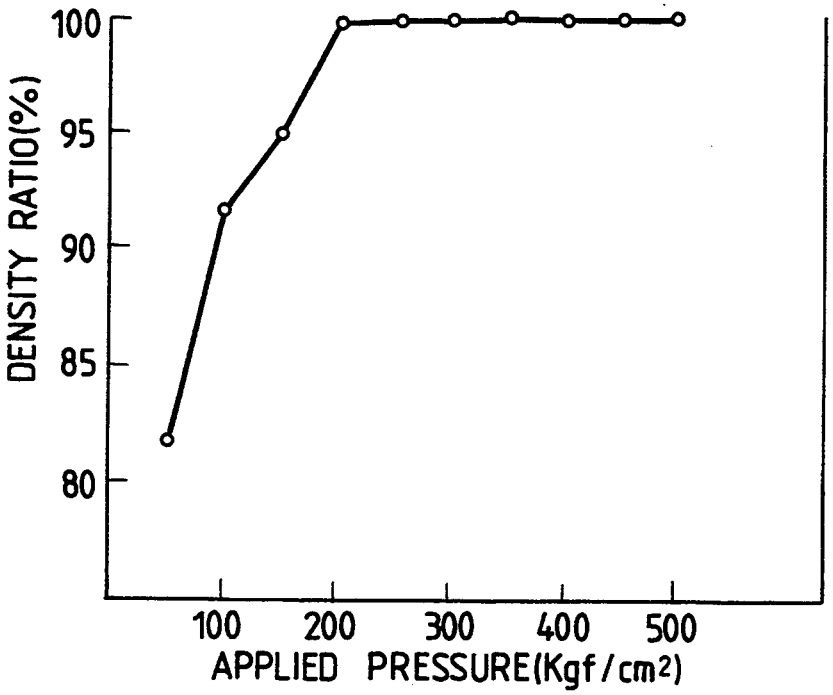
FIG. 3 is a diagram showing a relationship between applied pressure during sintering and the density ratio of the above embodiment.

FIG. 3 is a diagram showing a relationship between applied pressure during sintering and the density ratio of the resultant body. When the plasma sinter processing time of 12 minutes, the plasma current of 5000A and the plasma voltage of 5V are selected, a density ratio of more than 90% is obtained at the applied pressure of 100 Kgf/cm$^2$ and the optimum applied pressure under the same condition is 200 Kgf/cm$^2$.

Figure 4:
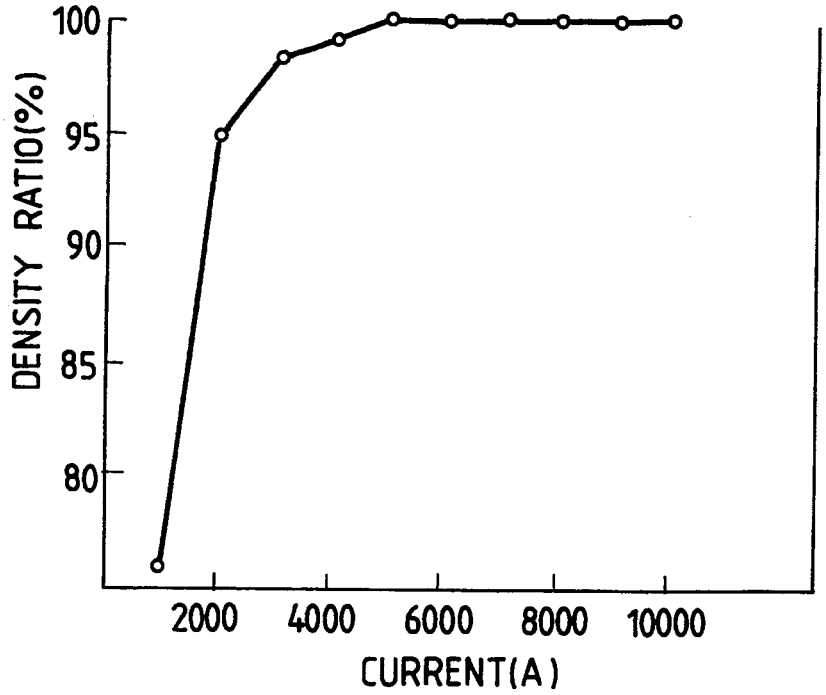
FIG. 4 is a diagram showing a relationship between plasma current and the density ratio of the above embodiment.

FIG. 4 is a diagram showing a relationship between plasma current and the density ratio of the resultant body. When the plasma sinter processing time of 12 minutes, plasma voltage of 5V and the applied pressure of 200 Kgf/cm$^2$ are selected, the optimum plasma current is 5000A and a density ratio of more than 90% is obtained by a plasma current of more than 1500A.

Figure 5:
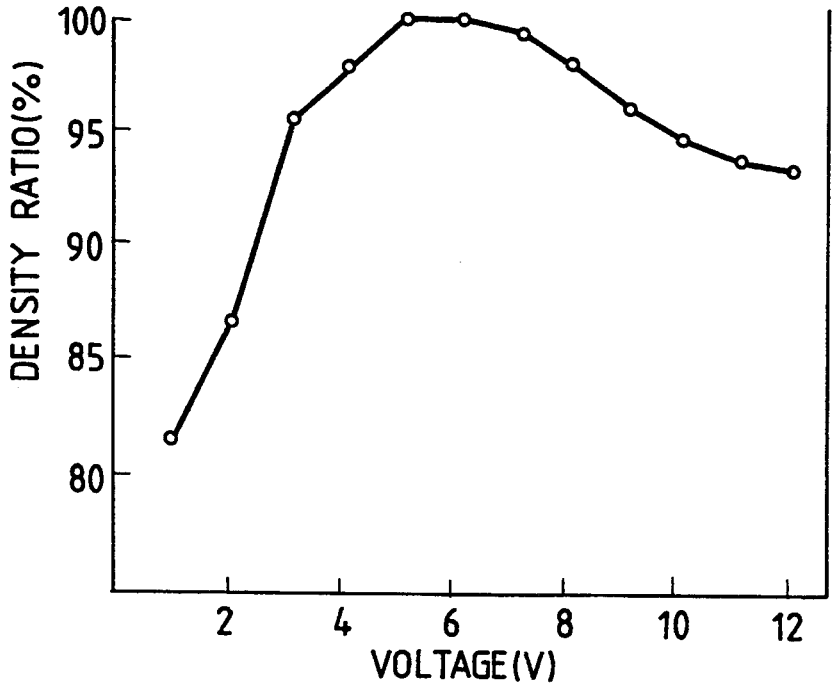
FIG. 5 is a diagram showing a relationship between plasma voltage and the density ratio of the above embodiment.

FIG. 5 is a diagram showing a relationship between plasma voltage and the density ratio of the resultant body. When the plasma sinter processing time of 12 minutes, the plasma current of 5000A and the applied pressure of 200 Kgf/cm$^2$ are maintained, the optimum plasma voltage is 5V and a density ratio of more than 90% can be obtained by a plasma voltage of more than 3V.

Figure 6:
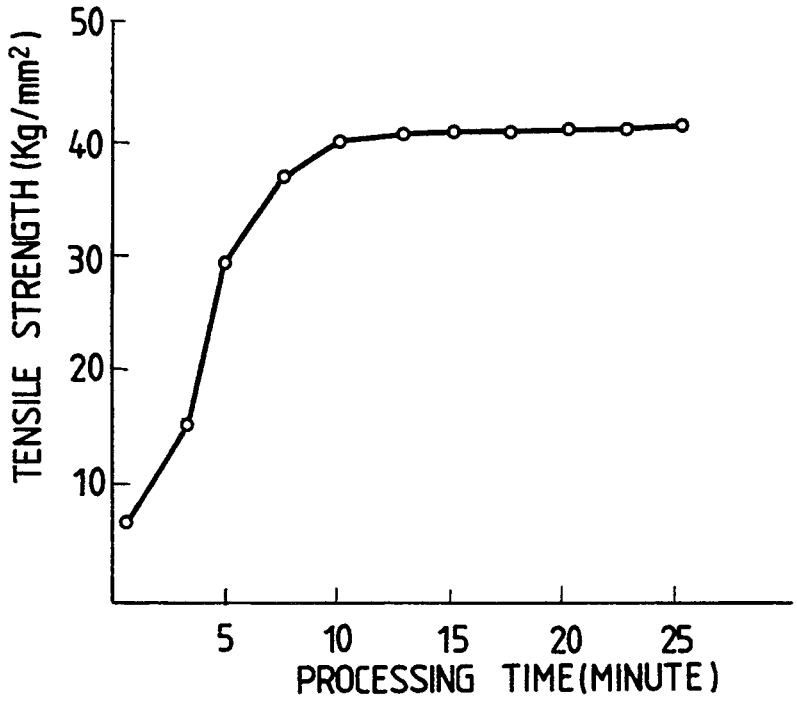
FIG. 6 is a diagram showing a relationship between plasma sinter processing time and tensile strength of the above embodiment.

FIG. 6 is a diagram showing a relationship between plasma sinter processing time and tensile strength of the resultant body. When the plasma current of 5000A, the plasma voltage of 5V and the applied pressure of 200 Kgf/cm$^2$ are maintained, the tensile strength of 16 Kg/mm$^2$ is obtained at the plasma sinter processing time of 5 minutes and a sufficient tensile strength of 40 Kg/mm$^2$ is obtained at the optimum plasma sinter processing time of 12 minutes. It was confirmed based on a micro structure photograph (illustration of which is omitted) of the resultant body that the boundary surface between the powder particles was closely coupled to maintain a sufficient mechanical strength.

Figure 7:
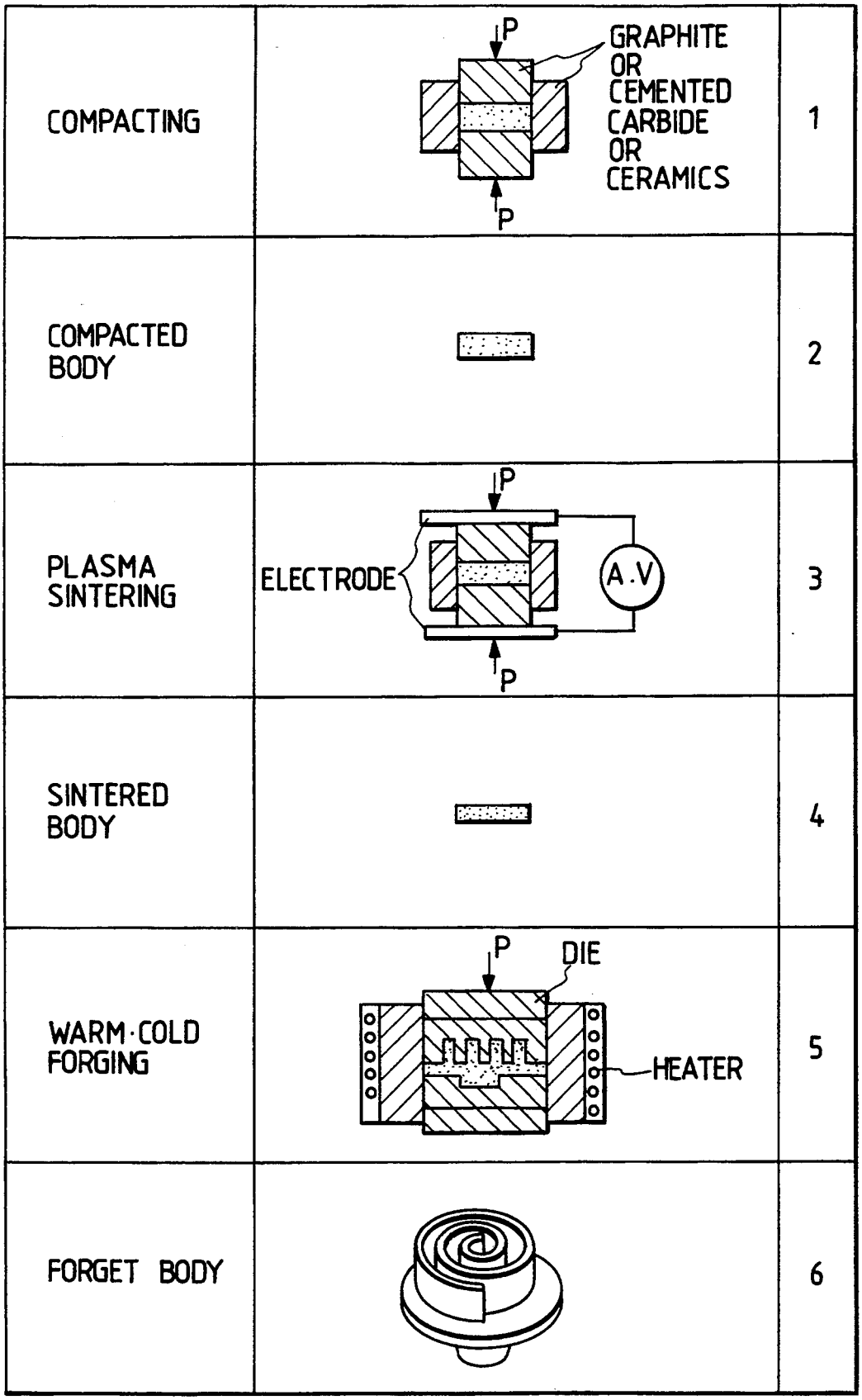
FIG. 7 is a schematic diagram of manufacturing processes of a scroll shaped part of another embodiment according to the present invention.

FIG. 7 is a schematic diagram for explaining a manufacturing processes of a scroll shaped part of another embodiment according to the present invention. In FIG. 7, 5 shows a warm . cold forging process and 6 is a forged body. The other numerals indicate the same processes and elements as in FIG. 1. In the present embodiment, the sintered body 4 of a flat plate which was manufactured via the compacting process 1 and the plasma sintering process 3 was subjected to the warm or cold forging process 5 to produce the forged body 6 of the scroll shaped part. Via the present method, the sintered body is subjected to a plastic working to thereby disappear internal defects therein and to further enhance the mechanical strength.

In the above embodiments, the manufacture of scroll shaped parts is explained, however present invention is of course applicable to Al alloy sintered parts having other complex shapes.

According to the present invention, parts having complex configurations made of sintered Al-Si series alloy having light weight, excellent mechanical strength and toughness are easily obtained, and since the plasma sintering method is employed such as a vacuum installation is dispensed with, the production cost thereof is reduced because of the reduced installation cost and the production efficiency is enhanced because the molded body can be sintered in a short time.

We claim:

1. A method of manufacturing sintered aluminum alloy parts characterized by comprising the steps of:

compression molding an Al alloy powder solidified by a rapid cooling which powder consists essentially of 1~45 wt % of Si, 0.5~5 wt % of Ce, 0.5~5 wt % of Zr, 0.1~9 wt % of at least one of 0.1 to 1.0 of Fe and an 0.1 to 9 wt % of an element selected from the group consisting of Y, Cu, Mg, Mn, Zn, Li, Co, Cr, Ni, W, Nb and Mo, and remainder wt % of Al; and thereafter sintering the compression molded alloy powder by heating via an electric current conduction therethrough in the form of a plasma discharge while applying pressure thereto.

2. A method of manufacturing sintered aluminum alloy parts according to claim 1 characterized in that the Al alloy powder essentially consists of 12.2~25 wt % of Si, 0.1 to 9 wt % of at least one element selected from the group consisting of Y, Cu, Mg, Mn, Zn, Li, Co, Cr, Ni, W, Nb and Mo 0.1 to 1.0 Fe and remainder wt % of Al.

3. A method of manufacturing sintered aluminum alloy parts according to claim 1 characterized in that, the Al alloy powder essentially consists of 1~ 45 wt % of Si, 1~5 wt % of Cu, 0.1~1.0 wt % of Fe, 0.1~2 wt % of Mn, 0.1~1 wt % of Mg, 0.5~5 wt % of Zr, and remainder wt % of Al.

4. A method of manufacturing sintered aluminum parts characterized by comprising the steps of:

compression molding an Al alloy powder solidified by a rapid cooling which powder essentially consists of 25 wt % of Si, 3.5 wt % of Cu, 0.5 wt % of Mg, 0.5 wt % of Fe, 0.5 wt % of Mn, 1.0 wt % of Zr, 2.0 wt % of Ce and remainder wt % of Al.

5. A method of manufacturing sintered aluminum alloy parts according to claim 1 characterized by further comprising the step of, forging the sintered body via one of warm forging or cold forging to obtain a forged body of a complex configuration.

6. A method of manufacturing sintered aluminum alloy parts according to claim 1 characterized in that, the sintering conditions with the plasma discharge are a plasma voltage of 2-10V, a plasma current of 1000~6500A, a sintering pressure of 50~300 Kgf/cm$^2$ and a sintering time of 5~20 minutes.

7. A method of manufacturing sintered aluminum alloy parts according to claim 2 characterized in that, the sintering conditions with the plasma discharge are a plasma voltage of 2-10V, a plasma current of 1000~6500A, a sintering pressure of 50~300 Kgf/cm$^2$ and a sintering time of 5~20 minutes.

8. A method of manufacturing sintered aluminum alloy parts according to claim 3 characterized in that, the sintering conditions with the plasma discharge are a plasma voltage of 2-10V, a plasma current of 1000~6500A, a sintering pressure of 50~300 Kgf/cm$^2$ and a sintering time of 5~20 minutes.

9. A method of manufacturing sintered aluminum alloy parts according to claim 4 characterized in that, the sintering conditions with the plasma discharge are a plasma voltage of 2-10V, a plasma current of 1000~6500A, a sintering pressure of 50~300 Kgf/cm$^2$ and a sintering time of 5~20 minutes.

* * * * *